US005802644A

United States Patent [19]

Scheurer

[11] Patent Number: 5,802,644

[45] Date of Patent: Sep. 8, 1998

[54] ROLL-UP TRAVEL PILLOW WITH COMPRESSION WRAPPER

[75] Inventor: Robert S. Scheurer, Wichita Falls, Tex.

[73] Assignee: Texas Recreation Corporation, Wichita Falls, Tex.

[21] Appl. No.: 877,388

[22] Filed: Jun. 18, 1997

[51] Int. Cl.[6] ..... A47G 9/02

[52] U.S. Cl. ..... 5/640; 5/643

[58] Field of Search ..... 5/419, 490, 491, 5/636, 639, 640, 643, 420

[56] References Cited

U.S. PATENT DOCUMENTS

| | | | |
|---|---|---|---|
| 2,940,088 | 6/1960 | Boos | 5/338 |
| 3,268,922 | 8/1966 | Moxley | 5/420 |
| 4,020,511 | 5/1977 | Terry | 5/337 |
| 4,031,578 | 6/1977 | Sweeney et al. | 5/337 |
| 4,218,792 | 8/1980 | Kogan | 5/436 |
| 4,329,747 | 5/1982 | Russell | 5/420 |
| 4,726,087 | 2/1988 | Schaefer et al. | 5/434 |
| 4,768,246 | 9/1988 | Summer | 5/434 |
| 4,788,728 | 12/1988 | Lake | 5/434 |
| 4,924,546 | 5/1990 | Main | 5/436 |
| 5,205,611 | 4/1993 | Sephens | 5/640 X |
| 5,228,158 | 7/1993 | Park | 5/636 |
| 5,291,625 | 3/1994 | Leslie | 5/420 |
| 5,297,304 | 3/1994 | O'Sullivan | 5/630 |
| 5,345,627 | 9/1994 | Cammarata | 5/419 |
| 5,535,467 | 7/1996 | Ciske | 5/636 |

*Primary Examiner*—Michael F. Trettel
*Attorney, Agent, or Firm*—Dennis T. Griggs

[57] ABSTRACT

A travel pillow includes a block of resilient, open cell foam material that can be compressed, rolled-up and secured within an outer protective covering. The outer protective covering includes a pre-stretched, dimensionally stable compression wrapper of a hook or loop-compatible fabric material, a strip of complementary hook or loop fastener material secured along one edge portion and a compression rod secured along an opposite edge portion of the wrapper. The resilient foam pillow block and protective compression wrapper are convolutely wound together about the compression rod as the resilient foam block is rolled-up and compressed. The pillow assembly is releasably secured in the rolled-up, compressed configuration by engagement of the complementary fastener strip with the hook or loop-compatible fabric material.

5 Claims, 7 Drawing Sheets

ROLL-UP TRAVEL PILLOW WITH COMPRESSION WRAPPER

BACKGROUND OF THE INVENTION

This invention relates generally to body support pillows and cushions, and in particular to a roll-up travel pillow.

Pillows and body support cushions used in the home and for recreational purposes have been subject to many improvements with respect to comfort and support. In addition to pillows, a variety of body support cushions, such as camping mats, mattresses, ground pads, pet beds, stadium cushions, pool/spa pillows, lumbar support cushions and neck support cushions, are used in connection with traveling, camping, backpacking, swimming, picnicing and attending sporting events, as well as at home.

Most pillows and other body support cushions that are capable of providing adequate support as well as comfort are difficult to manage during traveling, particularly since travel storage space is usually limited. Ordinary pillows and cushions are unsuited for travel purposes because of their bulk. Moreover, the linen coverings for such pillows and cushions may become soiled and wrinkled as a result of handling and exposure during travel.

Arrangements have been proposed for compressing and rolling-up pillows and cushions for convenient handling and storage. For example, U.S. Pat. No. 5,228,158 discloses a light-weight recreational pillow that can be rolled-up and secured by tie straps.

U.S. Pat. No. 5,535,467 discloses a flat pillow assembly that can be rolled-up to form a head rest or a neck roll support.

U.S. Pat. No. 5,205,611 discloses a travel pillow including a block of resilient foam rubber encased within a fabric covering that can be rolled-up when not in use, with the rolled-up portions being secured together by strips of hook-and-loop fastening material.

U.S. Pat. No. 5,297,304 discloses a rolled-up body support cushion that can be used either as a back support or as a neck support. The body support cushion is secured in the rolled-up configuration by co-acting hook-and-loop fastener strips that are secured onto opposite sides of the pillow.

Conventional roll-up pillow arrangements have not been entirely satisfactory because of difficulties encountered in producing a smooth, uniform roll that is compact and stable. A compact roll having a substantially uniform diameter is preferred for easy handling and storage purposes. Additionally, a uniform roll is preferred to avoid the formation of wrinkles in covering materials such as linen pillow cases, and also to avoid the formation of lumps within the pillow body.

Some pillow arrangements are difficult to secure and stabilize in the rolled-up configuration, particularly those that utilize external tie straps or mateable hook-and-loop fastener patches that must be overlapped with each other with adequate overlap area to provide reliable fastening engagement. Accurate overlapping alignment of the mateable fastener patches is made difficult by the e compressibility of the pillow stuffing material a and the e flexibility of the covering material.

For these reasons, there is a continuing interest in improving the portability as well as comfort and support provided by travel pillows and cushions.

BRIEF SUMMARY OF THE INVENTION

A roll-up travel pillow constructed according to the present invention includes a block of resilient, compressible material such as a low density, open cell foam resin. The resilient foam block is enclosed within a compression wrapper having hook or loop fastener-compatible fabric material on one s side and complementary hook or loop fastener material on the opposite side of the wrapper. The resilient foam pillow block is compressed as the pillow block and compression wrapper are convolutely rolled-up together. The complementary fastener material releasably engages the hook or loop fastener-compatible fabric material and thus secures the compression wrapper in the rolled-up, compressed configuration.

According to one aspect of the invention, uniformity of roll size is promoted by a compression rod that is secured a long one edge of the compression wrapper. Initial compression forces applied by the compression rod are uniformly distributed across the resilient foam block as rolling pressure is applied, thus producing a uniform compression core. This promotes uniform compression and distribution of the resilient material as the compression wrapper and resilient foam block are rolled in convoluted relation about the compression core, and thus reduces the formation of wrinkles and compacted lumps within the pillow body.

In the preferred embodiment of the invention, the outer covering of the compression wrapper is made of a flexible sheet of loop-type, hook-compatible fabric material, and a strip of complementary hook fastener material is attached to the opposite side of the wrapper. This arrangement permits random placement of the fastener strip for overlapping fastening engagement with the complementary loop material. Because the sheet of loop-type, hook-compatible fabric material is substantially coextensive in area with the compression wrapper, a mateable fastener surface is continuously available for reliable interlocking engagement with the strip of complementary hook-type fastener material independently of how tightly the resilient foam block may be compressed, and even though some compression wrapper misalignment may occur during roll-up.

BRIEF DESCRIPTION OF THE DRAWINGS

The operational features and advantages of the present invention will be understood by those skilled in the art upon reading the detailed description which follows with reference to the attached drawings, wherein.

DETAILED DESCRIPTION OF THE INVENTION

Figure 1:
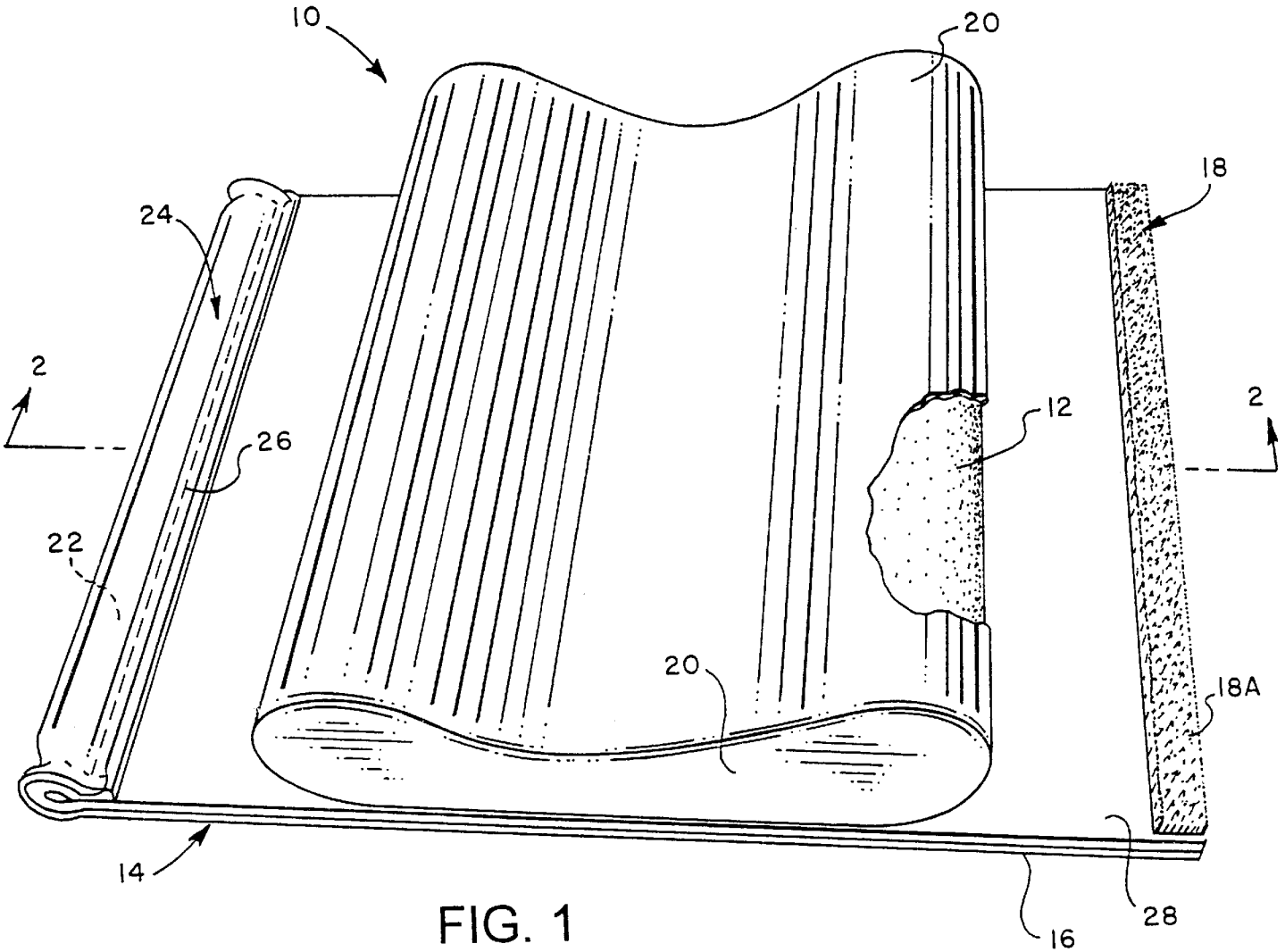
FIG. 1 is a perspective view of a travel pillow and a compression wrapper shown in an initial set-up prior to compression wrapping.

In the description which follows, like parts are indicated throughout the specification and drawings with the same reference numerals, respectively. The drawing figures are not necessarily to scale and the proportions of certain parts have been exaggerated for sake of clarity.

As used herein, "hook or loop-compatible fabric material" means and refers to a woven fabric material that includes hooks, loops, strands, threads, filaments or fibers that are releasably mateable in interlocking engagement with complementary hook or loop fastener material.

Figure 2:
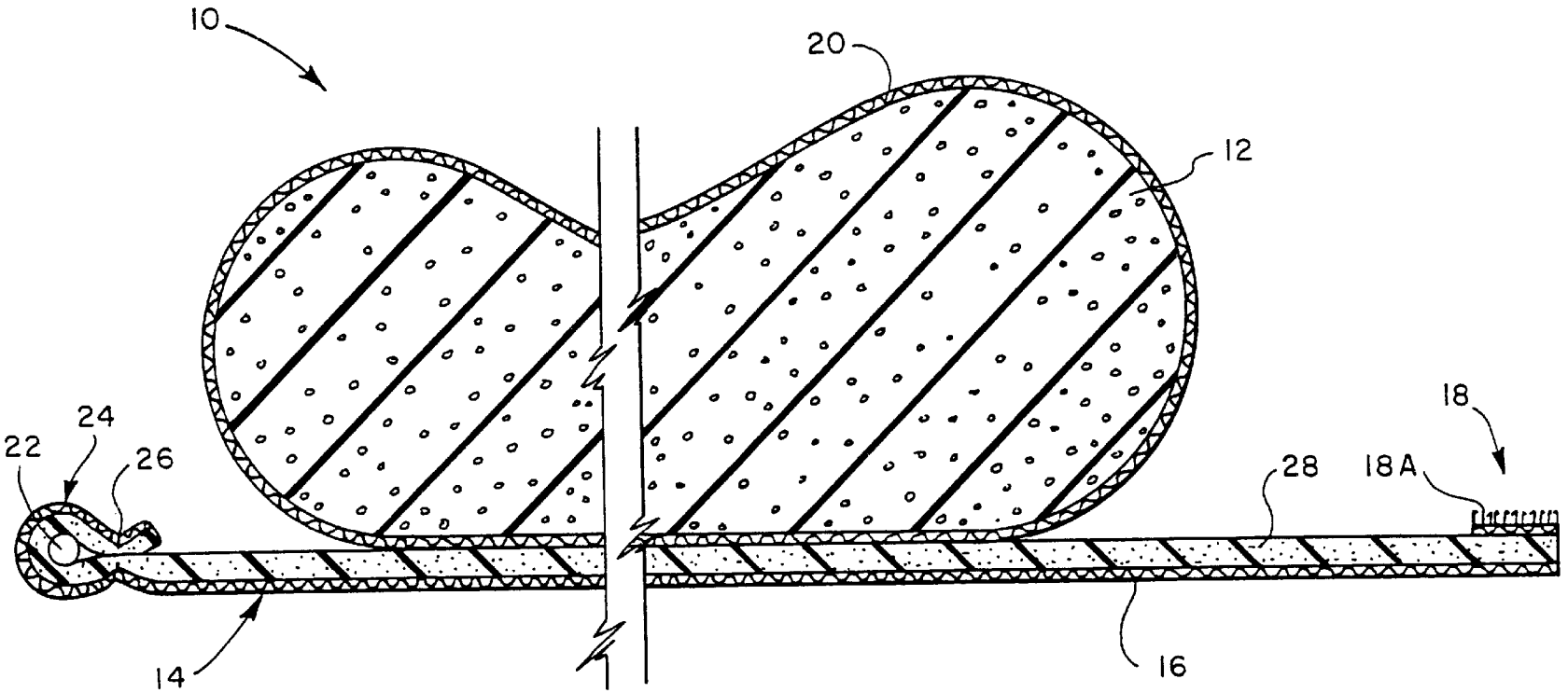
FIG. 2 is a sectional view thereof taken along the lines 2—2 of FIG. 1.
Figure 4:
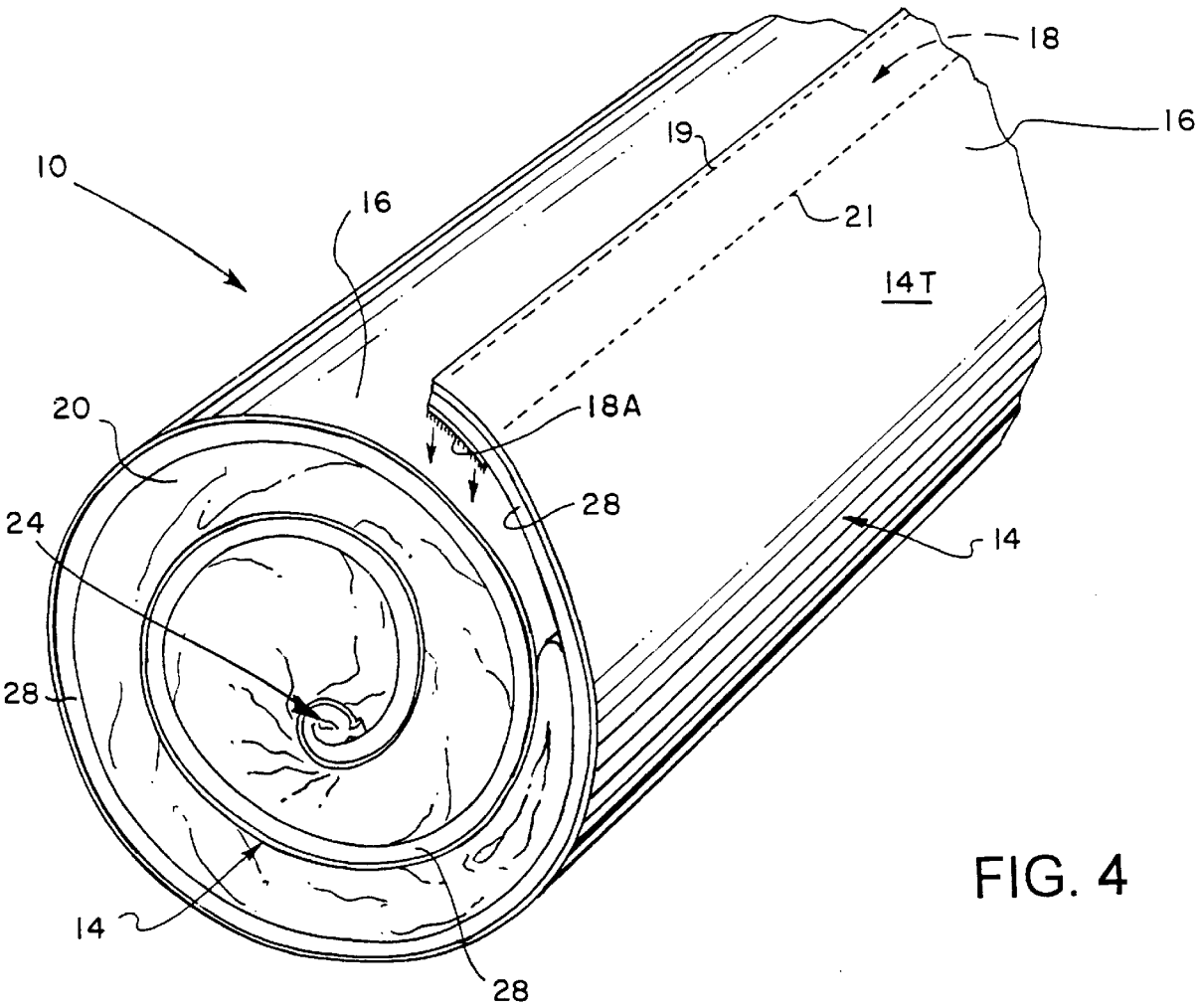
FIG. 4 is a perspective view thereof, in which the travel pillow and compression wrapper are almost completely rolled-up with the free end of the compression wrapper being moved into engagement with the hook or loop fastener-compatible fabric material of the compression wrapper.
Figure 5:
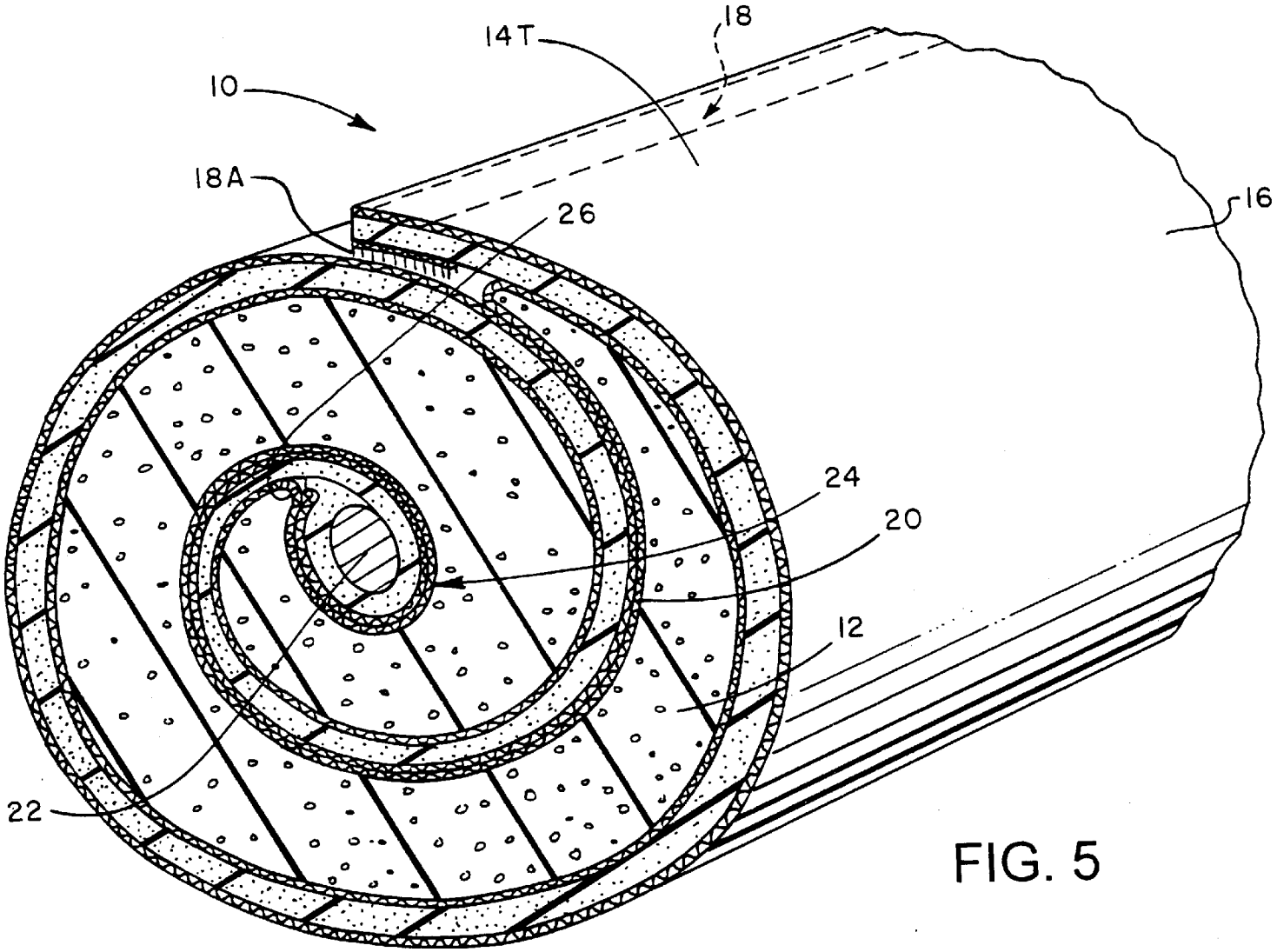
FIG. 5 is a perspective view thereof, partially in section, showing the completely rolled-up pillow and compression wrapper assembly.

Referring now to FIG. 1 and FIG. 2, a roll-up travel pillow assembly 10 constructed according to the preferred embodiment of the present invention includes a block of resilient, compressible material 12, a compression wrapper 14, a sheet of loop-type, hook-compatible fabric material 16 forming an external fastener surface on the compression wrapper, and a complementary hook-type, loop-compatible fastener strip 18 attached to the tail edge portion 14T of the compression wrapper on the wrapper side opposite to the fabric material 16. The compression wrapper 14 is substantially coextensive in width with the foam pillow block 12, but is somewhat longer so that the tail edge portion 14T extends beyond the compressed pillow material 12 when fully rolled-up, as shown in FIG. 4 and FIG. 5.

Preferably, the resilient foam pillow block 12 is formed of open cell polyurethane foam having a density of 1–6 lbs/cu.ft. As shown in FIG. 1, the foam block 12 is enclosed within a stretchable, form-fitted polyester knit covering 20 that is wrinkle-resistant and is ready for use after unrolling, and consequently does not require a separate pillow case or cover. The foam block 12 is contoured, but other forms including a plain rectangular block, sculptured or ribbon-top surface can be used according to personal preference.

The fastener strip 18 includes multiple rows of hook fasteners 18A. The fastener strip 18 is permanently attached to the compression wrapper 14, either by adhesive bonding or by threaded stitching 19, 21.

As shown in FIG. 1, FIG. 2, FIG. 8 and FIG. 9, a compression rod 22 is secured to the core edge portion 14C of the wrapper 14. The compression rod 22, preferably made of wood or plastic, is enclosed within a pocket 24A formed by a hem 24. The compression rod 22 is secured within the hem pocket by a threaded, stitched seam 26.

According to the preferred embodiment of the present invention, the compression wrapper 14 includes a low stretch backing reinforcement layer 16 so that it is dimensionally stable. As used herein, "dimensionally stable" means and refers to the ability of the compression wrapper 14 to substantially resist elongation in response to a tension force. Preferably, the elongation of the compression wrapper material is less than about two percent of its relaxed length in response to the tension forces induced in the compression wrapper during roll-up and compression of the polymer foam block 12.

Figure 7:
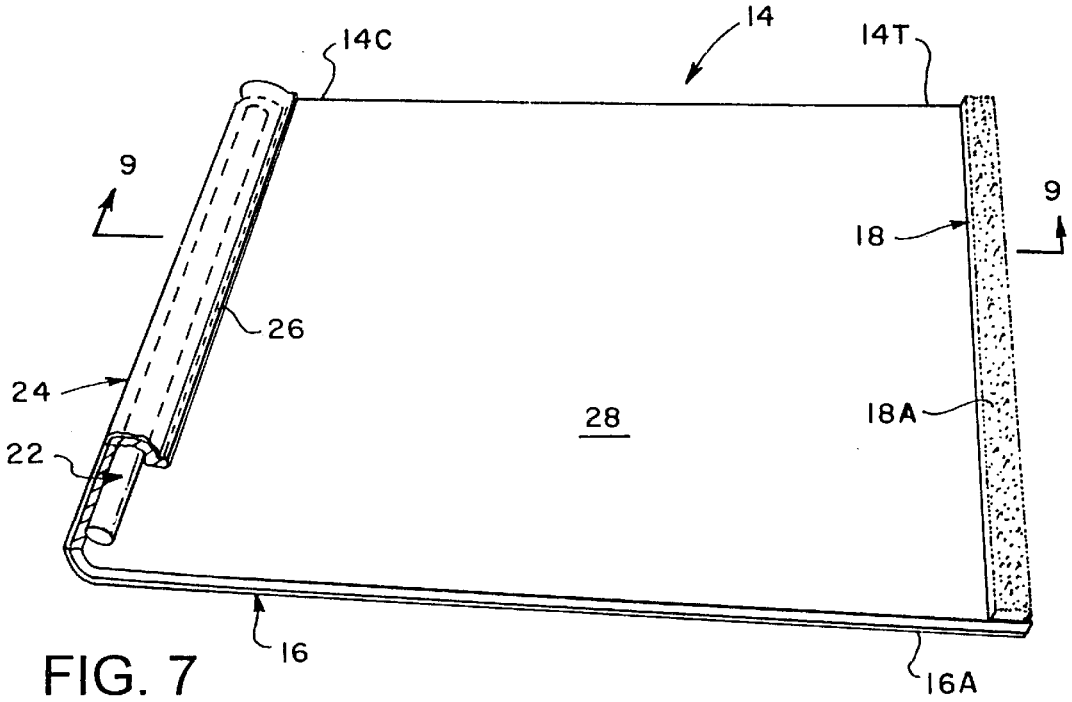
FIG. 7 is a perspective view of a compression wrapper constructed according to the present invention.
Figure 8:
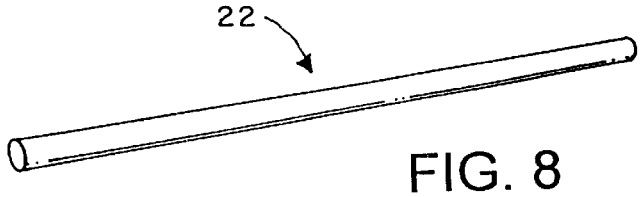
FIG. 8 is a perspective view of the compression rod shown in FIG. 7; and, FIG. 9 is a sectional view of the compression wrapper taken along the lines 9—9 of FIG. 7.
Figure 9:
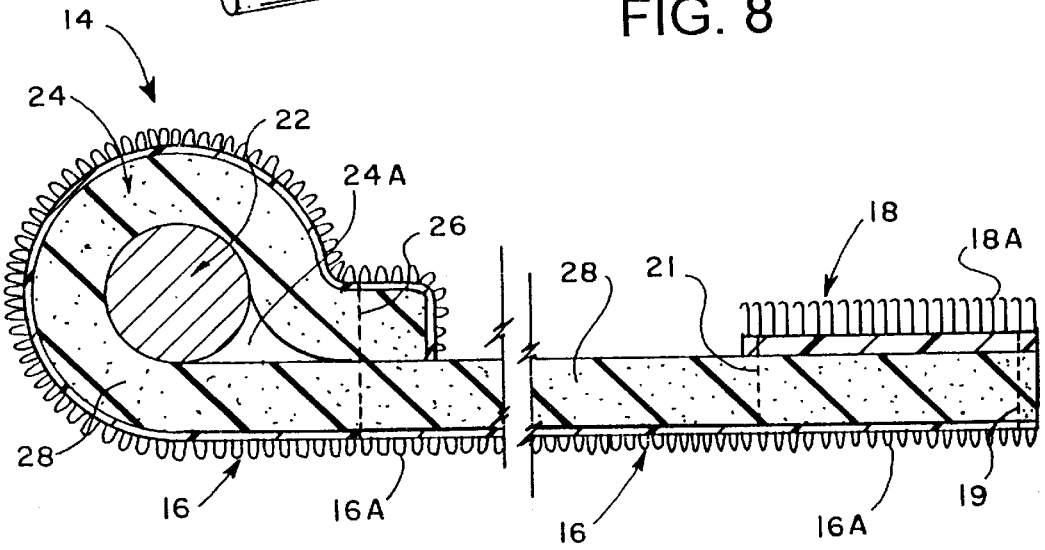

Referring now to FIG. 2, FIG. 7 and FIG. 9, the compression wrapper 14 is preferably formed as a lamination of synthetic woven material 16 that is fastener-compatible with hook-type fastener material. A suitable low-stretch, hook fastener-compatible fabric material 16 is spun polyester that is characterized by a soft, fuzzy surface made of small loops 16A. In the preferred embodiment, the polyester layer 16 is laminated and bonded to an inner layer 28 of open cell polyester foam, having an overall thickness of approximately one-quarter inch. The foam layer 28 provides body and further stabilizes the fabric. Moreover, the open cell polyester foam in the laminated combination provides a pinch-sealed edge when cut, which eliminates edge stitching.

Figure 3:
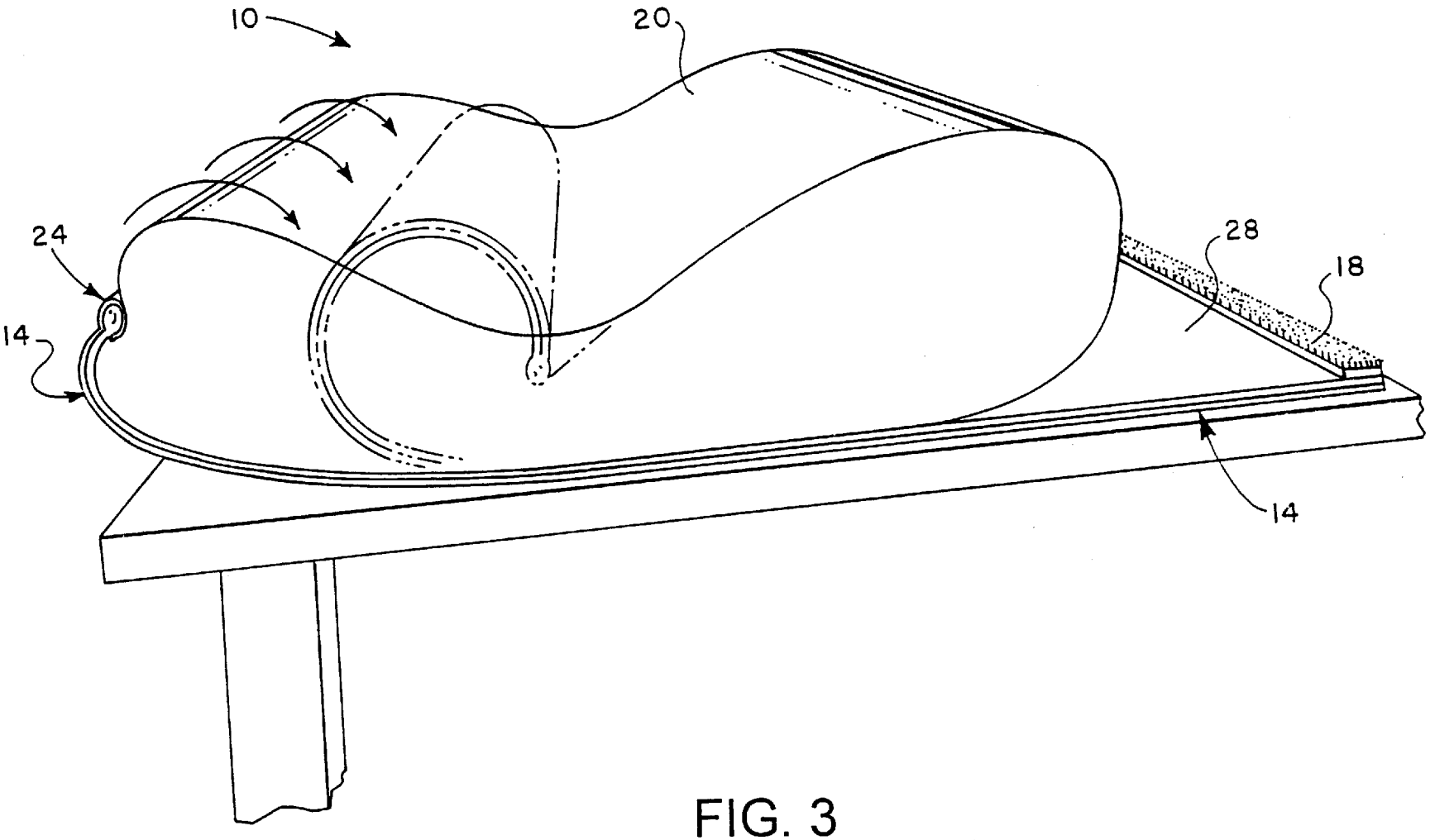
FIG. 3 is a perspective view showing the initial compression of the travel pillow in convoluted relation with the compression wrapper.

Referring now to FIG. 3, FIG. 4, FIG. 5 and FIG. 6, the pillow block 12 with its form-fitted covering 20 is rolled and compressed uniformly in convoluted relation with the compression wrapper 14. Initially, the compression wrapper 14 is laid flat on a table surface with its inner layer 28 exposed. Thereafter, the pillow is placed on the exposed wrapper surface between the fastener strip 18 and the compression rod 22, as shown in FIG. 1. Next, as shown in FIG. 3, the compression rod 22 and the core edge portion 14C of the compression wrapper 14 are curled around the adjacent pillow material.

As the compression rod 22 is pressed downwardly into the pillow, the compression wrapper 14 and the compressed pillow material are rolled clockwise and forward, as indicated by the arrows, thus producing a substantially cylindrical core. Rolling and compression of the pillow block are continued, gradually enlarging the compression core and bringing the tail edge portion 14T of the compression wrapper and the attached hook fastener strip 18 into engagement with the hook-compatible fabric material 16 as shown in FIG. 4.

Figure 6:
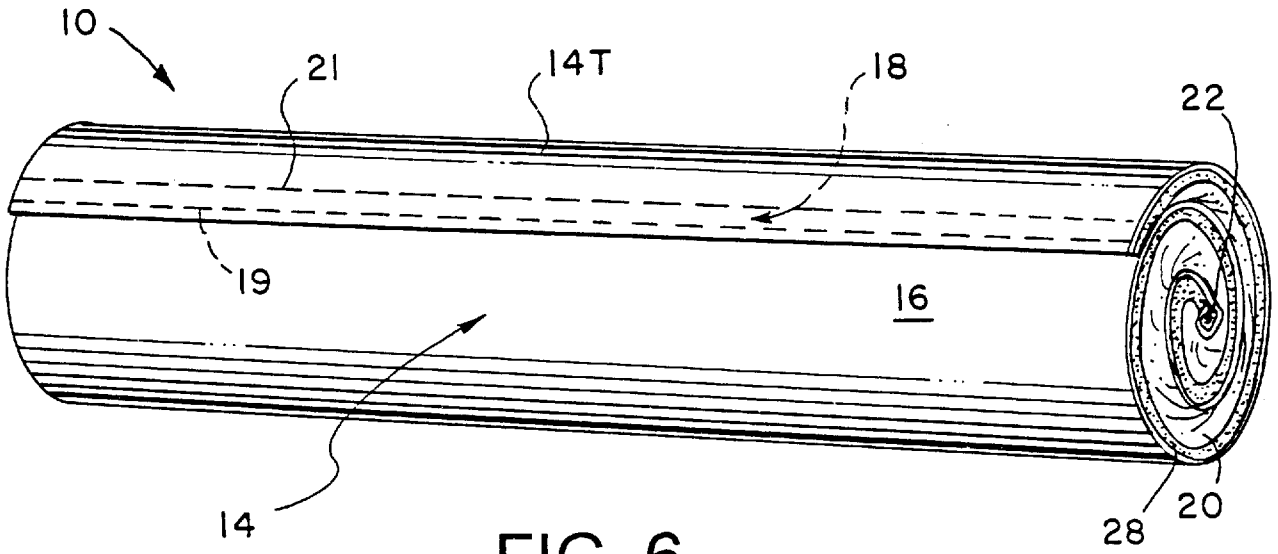
FIG. 6 is a front perspective view of the travel pillow and compression wrapper completely rolled-up and secured by engagement of hook-type, loop-compatible strip fastener with a sheet of loop-type, hook-compatible fabric material.

Referring now to FIG. 5 and FIG. 6, the fastener hooks 18A are manually pressed into interlocking engagement with the loops 16A of the underlying hook-compatible fabric material 16, thus securing the pillow and wrapper in substantially continuous rolled-up, compressed engagement. Since the underlying hook-compatible fabric layer 16 is continuous and substantially coextensive with the compression wrapper, exact placement of the hook fastener strip 18 is not required for reliable fastening engagement. Consequently, the pillow roll can be compressed and stabilized in different roll diameters, as may be desired for storage, back support, neck support and the like.

Preferably, the fastener-compatible surface area of the fabric material 16 is substantially co-extensive with the compression wrapper 14. However, the fastener-compatible fabric surface area need not be co-extensive and instead can extend from the marginal edge portion 14C over only a fraction of the wrapper, for example a rectangular strip having the same width but only one-fourth (¼) to one-third (⅓) of the wrapper length. The abbreviated arrangement provides adequate fastener overlap for a wide range of roll diameters.

Referring again to FIG. 3 and FIG. 4, a compression core can be established without using a compression rod. Instead, the marginal edge portion 14C of the compression wrapper is simply pressed into the initial fold and the enclosed foam material is compressed as the compression wrapper and core are rolled forward. A stable, uniform roll can be produced by this technique, but care must be taken to maintain uniform compression and distribution of the pillow material.

I claim:

1. A roll-up travel pillow comprising:

a block of resilient, compressible material;

a compression wrapper including a core end portion, a tail end portion and a sheet of hook-compatible or loop-compatible fabric material extending between the core end portion and the tail end portion, thereby forming an external fastener surface on the compression wrapper;

a strip of hook-compatible or loop-compatible fastener material secured onto the tail end portion; and, the compressible block and compression wrapper being rollable about the core end portion in convoluted relationship with each other in a compressed, rolled-up configuration, and the strip of complementary fastener material being engagable in a releasable interlocking union with the external fastener surface in the compressed, rolled-up configuration.

2. A roll-up travel pillow as defined in claim 1, including:

a compression rod secured onto the core end portion of the compression wrapper.

3. A roll-up travel pillow as defined in claim 1, including:

a pillow case of stretchable elastic fabric material enclosing said block of resilient, compressible material.

4. A roll-up travel pillow as set forth in claim 1, said sheet of fabric material comprising spun polyester fabric.

5. A roll-up travel pillow as set forth in claim 1, said sheet of fabric material comprising a layer of open cell polyester foam laminated onto a sheet of spun polyester fabric.

* * * * *